United States Patent [19]

Hart et al.

[11] 4,313,540

[45] Feb. 2, 1982

[54] CARTON WITH ARTICLE RETAINING STRUCTURE

[75] Inventors: Joseph J. Hart; John D. Desmond, both of Philadelphia, Pa.

[73] Assignee: Container Corporation of America, Chicago, Ill.

[21] Appl. No.: 170,724

[22] Filed: Jul. 21, 1980

[51] Int. Cl.[3] ..... B65D 5/50; B65D 85/30; B65D 5/06

[52] U.S. Cl. ..... 206/588; 206/491; 206/45.14; 220/445

[58] Field of Search ..... 206/521, 588, 591, 592, 206/45.14, 45.19, 45.31, 491; 229/40, 39 R; 220/445, 446, 447

[56] References Cited

U.S. PATENT DOCUMENTS

| | | | |
|---|---|---|---|
| 3,411,696 | 11/1968 | Ayer et al. | 229/40 |
| 3,784,136 | 5/1965 | Forbes, Jr. | 206/521 |
| 3,866,745 | 2/1975 | Dlugopolski | 206/45.14 |

*Primary Examiner*—William T. Dixson, Jr.

*Attorney, Agent, or Firm*—Richard W. Carpenter; Davis Chin

[57] ABSTRACT

A paperboard carton having integral internal structure for retaining a packaged article in a fixed position.

3 Claims, 10 Drawing Figures

CARTON WITH ARTICLE RETAINING STRUCTURE

SUMMARY OF THE INVENTION

The invention relates to folding cartons of the type used for the packaging of articles such as filled trays having flanges projecting laterally outward from upper portions thereof.

In packaging bakery type items which are contained in trays, it is essential to the protection of the packaged article that the tray be maintained in a fixed position against one wall, such as the bottom wall, of the carton.

It is therefore an object of the present invention to provide a folding carton formed from a unitary blank of foldable sheet material, such as paperboard, which includes an integral structure for engaging a portion of the packaged article and holding it against the bottom wall of the carton.

These and other objects of the invention will become apparent from an examination of the following description and drawings.

THE DRAWINGS

Figure 6:
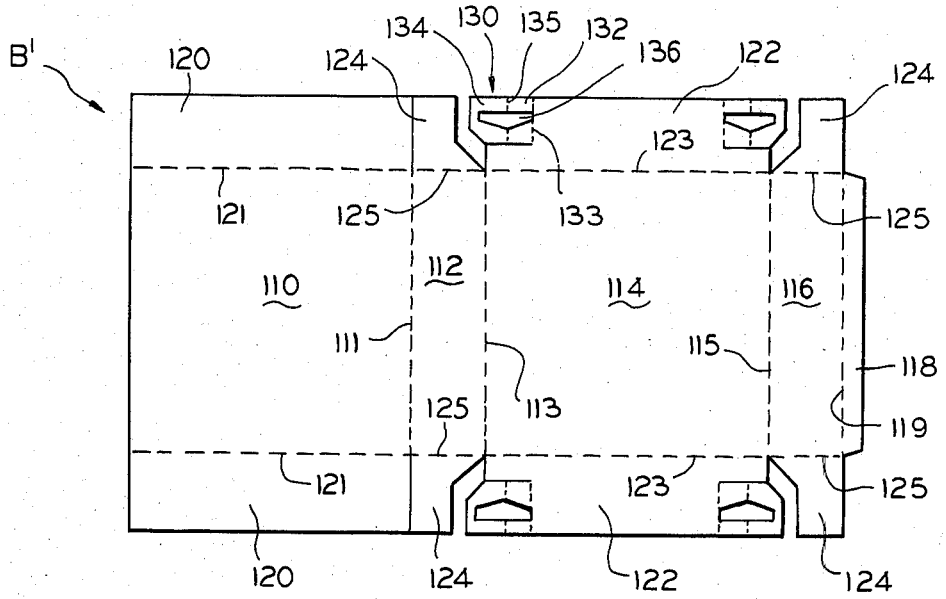
FIGS. 4 and 6 are views similar to FIGS. 1 and 3, respectively, but illustrating another embodiment of the invention.
Figure 4:
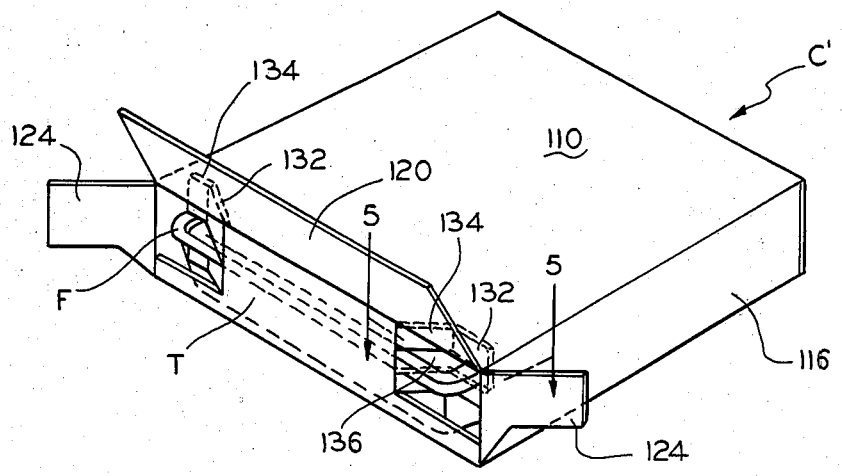
Figure 5:
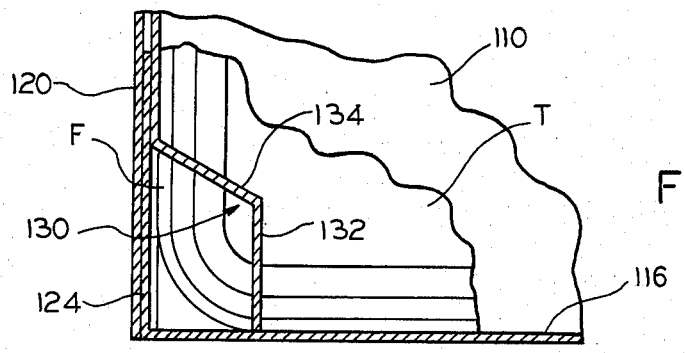
FIG. 5 is a fragmentary, horizontal section taken on line 5—5 of FIG. 4.
Figure 10:
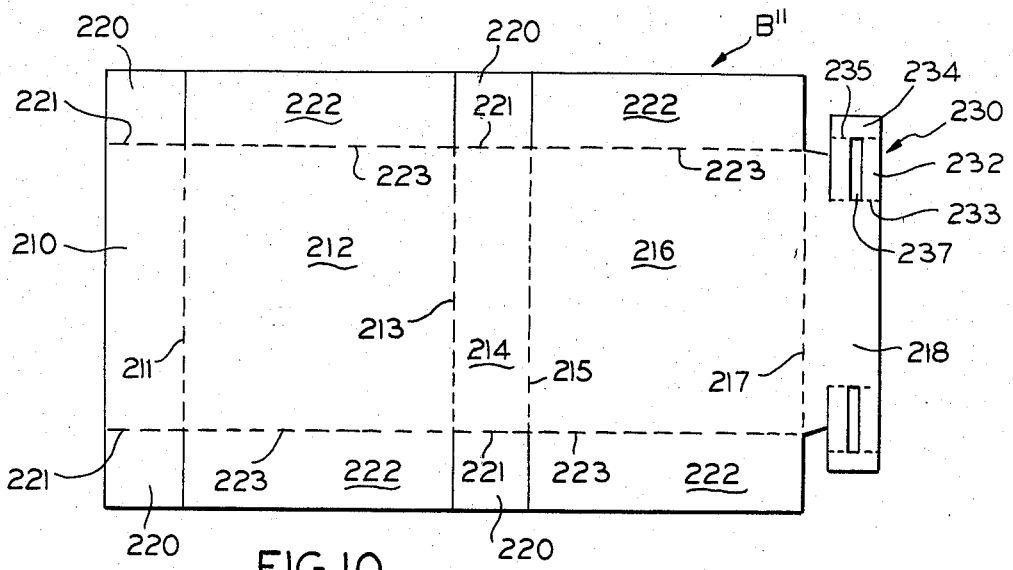
Figure 7:
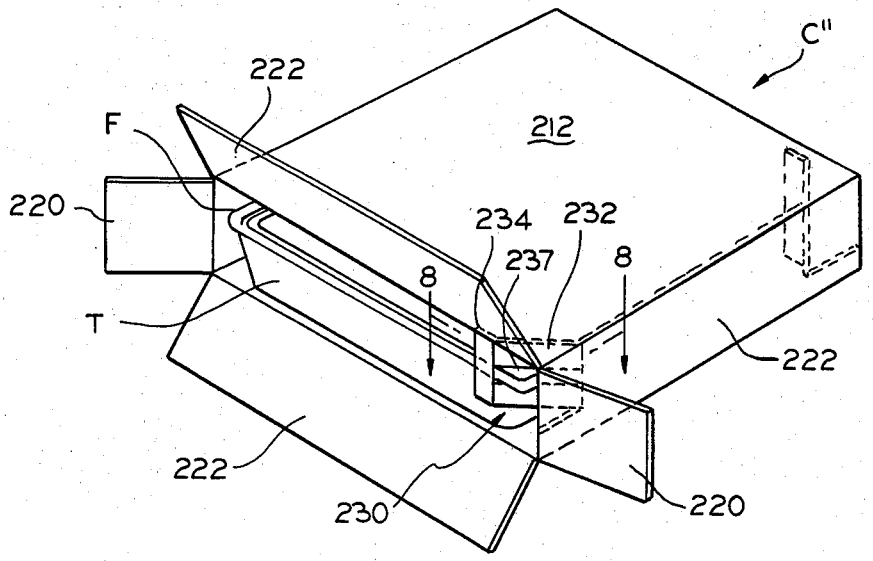
Figure 8:
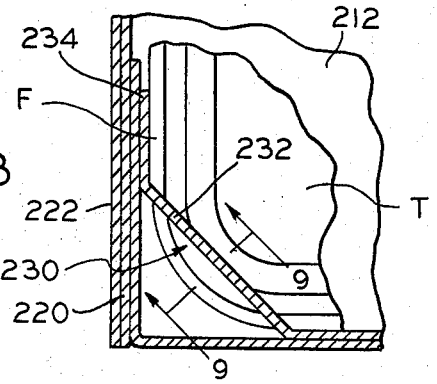
Figure 9:
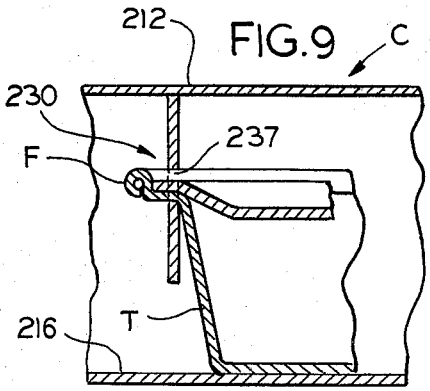

FIGS. 7, 8 and 10 are views similar to FIGS. 4, 5 and 6, but illustrating yet another embodiment of the invention; and FIG. 9 is a fragmentary vertical section taken on line 9—9 of FIG. 8.

THE DESCRIPTION

It will be understood that, for purposes of clarity, certain elements may have been intentionally omitted from certain views where they are believed to be illustrated to better advantage in other views.

Figure 3:
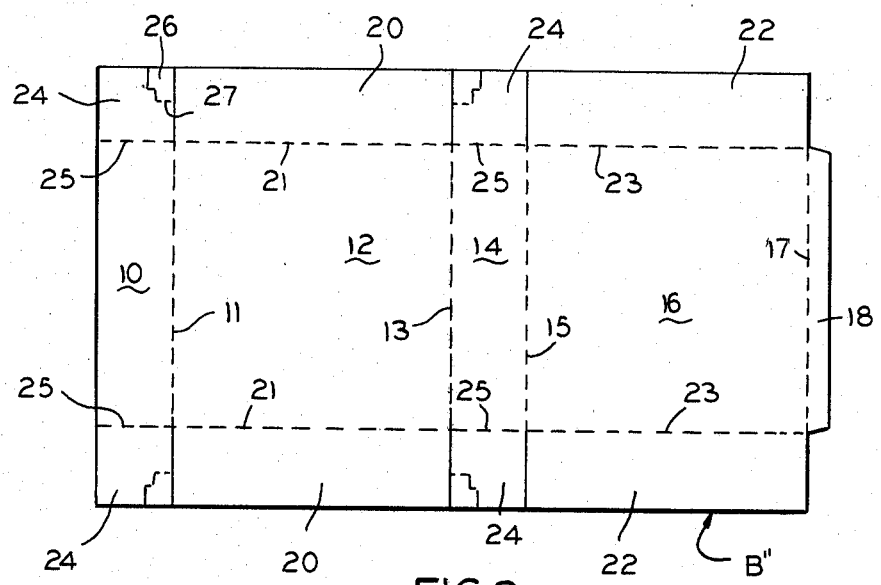
FIG. 3 is a plan view of a blank of foldable sheet material from which the carton illustrated in the other views may be formed.
Figure 1:
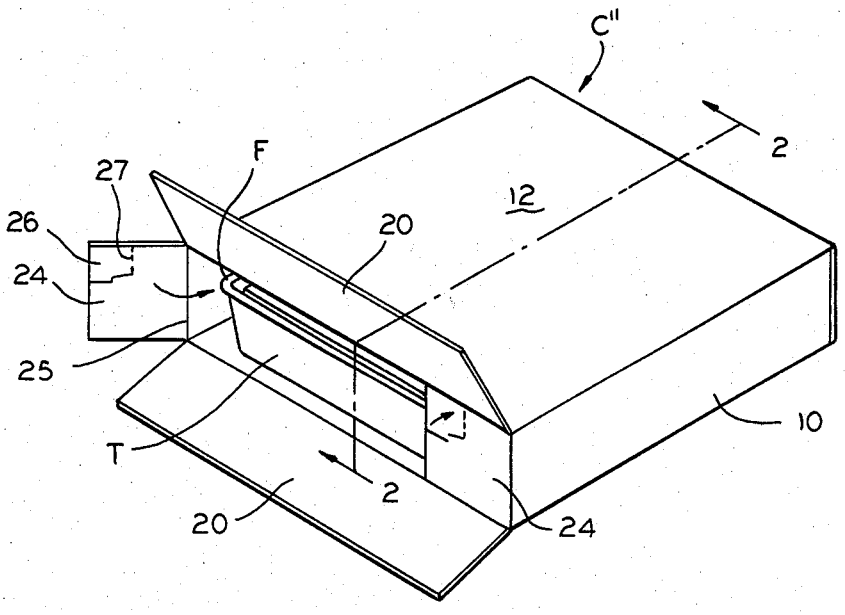
FIG. 1 is a perspective view of a carton embodying one form of the invention, as seen with a packaged article in position therewithin.
Figure 2:
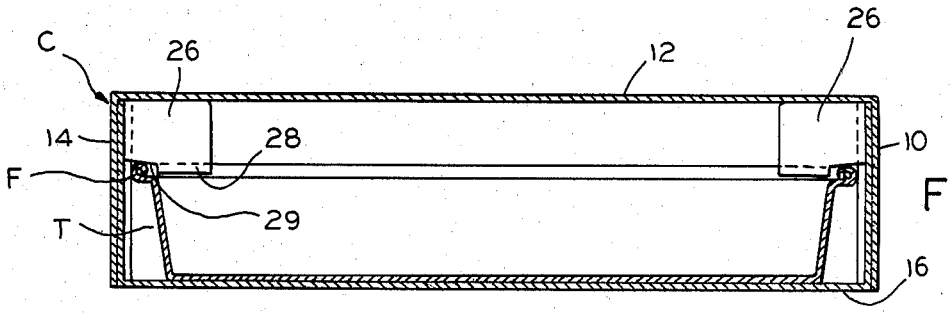
FIG. 2 is a vertical section taken on line 2—2 of FIG. 1.

Referring now to the drawings for a better understanding of the invention, it will be seen that one embodiment of the invention is illustrated in FIGS. 1–3.

The carton C″ of FIGS. 1 and 2, shown enclosing a tray T having an outwardly projecting flange F, may be formed from the unitary blank B of foldable sheet material such as paperboard illustrated in FIG. 3.

As best seen in FIG. 3, the body of the carton includes a first side wall 10, a top wall 12, a second side wall 14, a bottom wall 16, and a glue flap 18, which are foldably joined to each other along parallel fold lines 11, 13, 15 and 17.

First and second pairs of major end wall panels 20 and 22 are foldably joined to the opposite ends of top and bottom walls 12 and 16, along fold lines 21 and 23, respectively.

First and second pairs of minor end wall panels or retaining panels 24 are foldably joined to the opposite ends of side walls 10 and 14 along fold lines 25.

Each of the retaining panels 24 is provided with a lock tab 26 which is foldably joined to an outer upper corner of related retaining panel 26 along a fold line 27 which is parallel to and spaced outwardly from related fold line 25. Each lock tab 26 has at its outer end an downwardly extending projection 28 and presents a recess 29 located between projection 28 and fold line 27.

When the carton is in erected condition, as shown in FIG. 1, with the tray T inserted within the carton, the retaining panels 24 are folded inwardly at right angles to their related side walls, as shown in the right side of FIG. 1. Then, in order to maintain the tray in fixed position within the carton and against the bottom wall of the carton, each of the lock tabs 26 is folded inwardly at a right angle to its related retaining panel 24 to engage the upper portion of the tray, as best illustrated in FIG. 2. It will be seen that the recess 29 of each lock tab receives the upper portion of the tray flange F while the projection 28 of each lock tab extends downwardly against the top of the tray and inboardly of the flange F. Thus, shoulder type abutments are provided by the lock tabs 26 at the corners of the tray to maintain the packaged article or tray in fixed position.

Referring now to FIGS. 4–6 of the drawings, it will be seen that another embodiment of the invention is shown. In this embodiment a carton C′, formed from a blank B′, is designed to hold a tray T having an outer flange F projecting laterally outwardly from an upper portion thereof.

As best seen in FIG. 6, the body of the carton includes a top wall 110, a first side wall 112, a bottom wall 114, a second side wall 116, and a glue flap 118 which are foldably joined to each other along parallel fold lines 111, 113, 115, and 117, respectively.

A pair of outer end wall panels 120 are foldably joined along fold lines 121 to opposite ends of top wall 110, and a pair of inner end wall panels 122 are foldably joined along fold lines 123 to opposite ends of bottom wall 114. Also, pairs of end flaps 124 are foldably joined along fold lines 125 to opposite ends of first and second side walls 112 and 116, respectively.

Each of the inner end wall panels 122 has foldably joined to opposed ends thereof retaining panels 130 which are formed from portions of the material of the related inner end wall panel 122.

Each of the retaining panels 130 includes a first section 132 foldably joined on fold line 133 to inner end panel 122 and a second section 134 foldably joined on fold line 135 to the outer end of first section 132.

Formed within each of the lock panels 130 is a laterally extending opening or slot 136, the purpose of which is described hereinafter.

As best seen in FIG. 4, when the carton is in erected condition with the flanged tray T in position, to close the ends of the carton the inner end wall panels 122 are folded upwardly at right angles to bottom wall 114 and retaining panels 130 are folded inwardly from panels 122 with first sections 132 extending generally at right angles from panel 122 and with second sections 134 extending outwardly from and generally at right angles to first sections 132 to provide a corner structure wherein the slot or opening 136 of each retaining panel 130 receives a portion of the flange F of tray T to maintain it in fixed position within the carton C against the bottom wall 114.

Referring now to FIGS. 7–10, it will be seen that yet another embodiment of the invention is shown. In this embodiment the carton C″ of FIG. 7 is formed from a blank B″ of FIG. 10, of paperboard and is adapted to enclose a tray T having a flange F projecting laterally outward from an upper portion thereof.

As best seen in FIG. 10, the body of the carton C″ includes a first side wall 210, a top wall 212, a second side wall 214, a bottom wall 216, and a glue flap 218 which are foldably joined to each other along parallel fold lines 211, 213, 215 and 217, respectively. Opposed pairs of minor end wall panels 220 are foldably joined along fold lines 221 to opposite ends of each of the side wall panels 210 and 214, and opposed pairs of major end wall panels 222 are foldably joined along fold lines 223 to opposite ends of top and bottom walls 212 and 216.

Foldably joined to opposite ends of glue flap 218 are a pair of retaining panels 230 which are formed at least partially from material cut from glue flap 218. Each of the retaining panels 230 includes a first section 232, foldably joined on fold line 233 to flap 218, and a second section 234, foldably joined on fold line 235 to the outer end of first section 232. Each of the retaining panels 230 includes a laterally extending opening or slot 237 which is adapted to receive a corner of the tray flange F, as shown in FIGS. 7–9. When the carton is in erected condition, as shown in FIG. 7, with the tray T in position, the retaining panels 230 are folded into the carton with first sections 232 extending diagonally across the corners of the tray and with second sections 234 lying in face-to-face relation with the inner surface of an adjacent major end wall panel 222. Thus, the structure serves to maintain the tray in fixed position within the carton against the bottom wall.

We claim:

1. A carton, formed of a unitary blank of foldable paperboard, including intergral structure for holding in a fixed position, a generally rectangular tray having a flange projecting laterally outward from an upper portion thereof, said carton comprising:

(a) a pair of opposed top and bottom horizontal walls;

(b) opposed pairs of side and end vertical walls foldably joined to each other on first fold lines and to said horizontal walls on second fold lines, which extend normal to said first fold lines, to define a box-like enclosure; and (c) retaining panels foldably joined to opposite ends of said opposed end vertical walls, each of said retaining panels having at its outer end a downwardly extending projection and at its inner end a recessed shoulder to provide an abutment in which the shoulder receives the upper portion of a flange of a tray, and the projection extends downwardly against the top of the tray and inboardly of the flange to hold the tray in a fixed position against said bottom wall.

2. A carton, formed of a unitary blank of foldable paperboard, including integral structure for holding in a fixed position, a generally rectangular tray having a flange projecting laterally outward from an upper portion thereof, said carton comprising:

(a) a pair of opposed top and bottom horizontal walls;

(b) opposed pairs of outer end wall panels foldably joined to opposite ends of said top wall;

(c) opposed pairs of inner end wall panels foldably joined to opposite ends of said bottom wall;

(d) retaining panels formed of a first section and a second section and foldably joined to each other and to said inner end wall panels, said first sections of said retaining panels being disposed at an angle less than ninety degrees with respect to said related inner end wall panels, said second sections of said retaining panels being disposed generally normal to said related first sections; and (e) said first and second sections of said retaining panels having a laterally extending opening to provide a corner structure receiving a portion of a flange of the tray to maintain it in a fixed position against said bottom wall.

3. A carton, formed of a unitary blank of foldable paperboard, including integral structure for holding in a fixed position, a generally rectangular tray having a flange projecting laterally outward from an upper portion thereof, said carton comprising:

(a) a pair of opposed top and bottom horizontal walls;

(b) opposed pairs of side and end vertical walls foldably joined to each other on first fold lines and to said horizontal walls on second fold lines, which extend normal to said first fold lines, to define a box-like enclosure;

(c) a glue flap foldably joined to one of said opposed top and bottom walls;

(d) retaining panels formed of a first section and a second section and foldably joined to each other and to said glue flap, said first sections of said retaining panels being extended diagonally across the corner of a tray, said second sections of said retaining panels being disposed in face-to-face relation with the inner surface of the adjacent end vertical walls; and (e) said first and second sections of said retaining panels having a laterally extending opening to provide a corner structure receiving a portion of the flange of the tray to maintain it in a fixed position against said bottom wall.

* * * * *